United States Patent [19]

David et al.

[11] Patent Number: 4,766,798

[45] Date of Patent: Aug. 30, 1988

[54] SHELL LOADER

[75] Inventors: Donald M. David; Melvin R. Holmes; Larry E. Hoback; Ronnie L. Reiber, all of Grand Island, Nebr.

[73] Assignee: Hornady Manufacturing Company, Grand Island, Nebr.

[21] Appl. No.: 59,046

[22] Filed: Jun. 8, 1987

[51] Int. Cl.[4] ..... F42B 33/02; F42B 33/00

[52] U.S. Cl. ..... 86/27; 86/23; 86/24; 86/25; 86/36; 86/37; 86/44; 86/45; 86/46

[58] Field of Search ..... 86/23, 24, 25, 26, 27, 86/46, 45, 44, 36, 37

[56] References Cited

U.S. PATENT DOCUMENTS

| | | | |
|---|---|---|---|
| 3,097,560 | 7/1963 | Ponsness et al. | 86/27 |
| 3,483,792 | 12/1969 | Williams | 86/27 |
| 4,031,804 | 6/1977 | Boschi | 86/27 |
| 4,343,222 | 8/1982 | Dillon | 86/23 |
| 4,522,102 | 6/1985 | Pickens | 86/27 |
| 4,526,084 | 7/1985 | David et al. | 86/27 |
| 4,615,255 | 10/1986 | Carter | 86/27 |

*Primary Examiner*—Stephen J. Lechert, Jr.
*Assistant Examiner*—Howard J. Locker
*Attorney, Agent, or Firm*—Vincent L. Carney

[57] ABSTRACT

To permit automatic ejection of shells in a progressive shell loader, a cam is mounted near the turret holding the shells. As the carriage is raised and lowered, two pawls and an index wheel turn it so that the shells advance toward a final station. Immediately prior to the final station, the cam engages a spring-biased lever to cause it to eject the reloaded shell. The pawls engage camming surfaces formed on the bottom of a single-piece index wheel to turn it.

5 Claims, 6 Drawing Sheets

SHELL LOADER

BACKGROUND OF THE INVENTION

This invention relates to metallic cartridge loaders.

In one class of loaders, a shell holder is adapted to receive a plurality of shells or casings and is mounted to a carriage which is movable in a vertical direction. A handle is connected to a toggle drive mechanism to raise and lower the carriage as the handle is pivoted between substantially vertical and horizontal positions.

During raising and lowering of the carriage, an automatic indexing mechanism turns the shell holder to advance the shells progressively from position to position. At the top of the motion of the carriage, the shells contact a tool station which operates on the shells to refinish and load them. In the downward motion of the shell holder, the shell is primed.

In the prior art loaders, the reloaded cartridges are manually removed. This procedure has the disadvantages of slowing operation of the reloader, and including a relatively expensive indexing mechanism for the shell holder.

SUMMARY OF THE INVENTION

Accordingly, it is an object of the invention to provide a novel cartridge loader.

It is a still further object of the invention to provide a novel method of reloading shells.

It is a still further object of the invention to provide a novel apparatus and method for progressively reloading shells with a hand-operated mechanism in which it is not necessary to perform hand operations for priming or removing shells other than by operation of an operating lever.

It is a still further object of the invention to provide a novel apparatus and method for reloading shells in which finished cartridges are automatically expelled.

In accordance with the above and further objects of the invention, a loader includes a shell plate and a shell holder. The shell holder and shell plate are mounted to a carriage which is moved upwardly toward tools and downwardly toward a base. A plurality of shells held by the shell holder are automatically advanced on both the upward and downward motions of the carriage by rotation of the shell holder on the shell plate to progressively refinish and load the shells. At a first station a shell is sized and deprimed on the upward movement of the carriage and primed in the downward movement of the carriage and in the last station the shell is expelled automatically.

A cam is mounted so that it engages a springbiased lever as the shell plate is lowered to move the lever into engagement with the shell as it approaches the last station, thus causing the shell to be ejected into a bin. The lever is biased to return to position on the shell plate.

For economical construction and ease of use, the automatic indexing mechanism includes a single piece index wheel which is engaged by pawls as the carriage moves upwardly and downwardly to rotate the shell holder connected thereto. The shell holder is replaceably and rotatably mounted to the subplate 184 with the movement being partly gaged by a detent in the shell holder and a circle of detent openings in the subplate 184, each opening representing a different position of the shell holder in its rotation.

From the above description it can be understood that several advantages are provided by the loader 10 such as: (1) it is relatively simple and inexpensive (2) it is relatively safe; and (3) it permits easy removal and insertion of shells.

SUMMARY OF THE DRAWINGS

The above noted and other features of the invention will be better understood from the following detailed description when considered with reference to the accompanying drawings in which.

DETAILED DESCRIPTION

Figure 1:
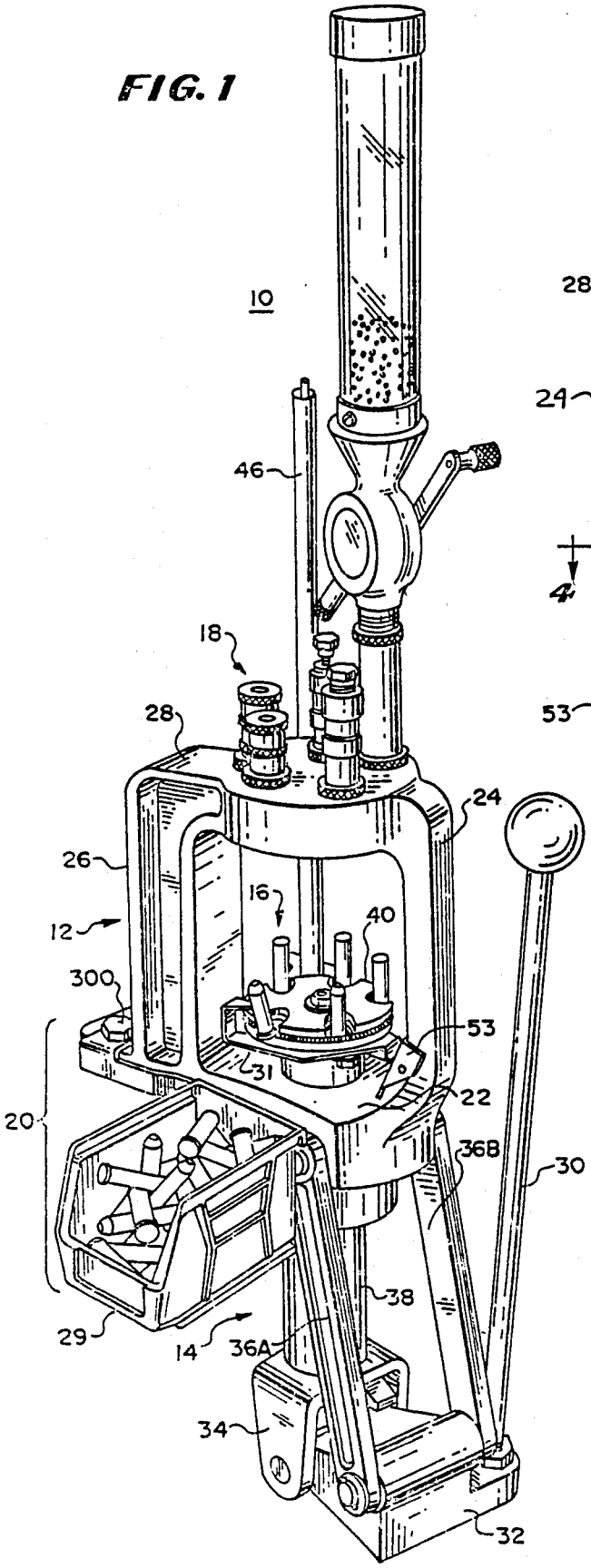
FIG. 1 is a perspective view of a loader in accordance with an embodiment of the invention.

In FIG. 1, there is shown a perspective view of a reloading apparatus 10 having a frame indicated generally at 12, a drive means 14, a turret section 16, a refinishing and loading section 18 and a case ejector assembly 20, partly hidden in FIG. 1.

The frame 12 is adapted to be mounted to a work bench or the like and to support in cooperative arrangement: (1) the drive means 14 mounted below the frame 12; (2) the turret section 16 mounted to the drive means 14; (3) the tooling and loading section 18 at the top of the frame to cooperate with the turret section 16; and (4) the case ejector assembly 20 mounted on the frame to cooperate with the turret section 16 and the frame 12. A plurality of metallic shells are mounted on the turret section 16.

To support the other parts of the reloading apparatus 10, the frame 12 is generally formed as a closed square loop having: (1) a base 22; (2) a first upstanding column 24 on one side of the base 22; (3) a second vertical upstanding column 26 on the opposite side of the base 22 parallel to the column 24; and (4) a top supporting member 28 parallel to the base 22 and adjoining the upper ends of the vertical parallel upstanding columns 24 and 26.

To guide the turret section 16, the base 22 of the frame 12 includes a cylindrical aperture passing through it to receive the top portion of the drive means 14. To support the case ejection assembly 20, the base 22 of the frame 12 includes a flat upper surface and a front vertical wall, with the case ejection assembly 20 generally bridging the turret section 16 and the base 22 to eject cartridges from the turret section 16 and collect them in a manner to be described hereinafter. The drive means 16 is pivotably mounted to a lower collar on the frame.

To mount the reloader to a bench or the like, the second vertical upstanding column 26 has a cross-section of an I-beam and a bottom mounting plate adapted to be clamped or bolted to the work bench. This frame is substantially the same as the frame disclosed in U.S. Pat. No. 4,526,084, granted July 2, 1985, to David et al. and assigned to Hornady Manufacturing Company. The disclosure of the aforementioned patent is incorporated herein by reference to it as part of this disclosure.

To move the turret section 16 between the refinishing and loading section 18 and the base 22, the drive means 14 includes a handle 30, a rocker arm 32, a yoke 34 and a pair of linkage arms 36A and 36B. The handle 30 is connected to the rocker arm 32 which in turn is mounted for movement within the yoke 34 and the linkage arms 36A and 36B.

To lower the turret section 16 when the handle 30 is in a substantially vertical position as shown in FIG. 1, the linkage arms 36A and 36B connect the rocker arm 32 pivotably to the frame 12 and the rocker arm 32 is connected pivotably to the yoke 34. The yoke 34 is connected at its top to the turret section 16. To move the yoke 34 upwardly and thus drive the turret section 16 upwardly, the rocker arm 32 rotates about the linkage arms 36A and 36B when the handle 30 is pulled forward and down to a more horizontal position from that shown in FIG. 1. The drive means 14 is substantially the same as that shown in the aforesaid patent to David et al. and to that used in the Pro-7 Progressive, reloaders sold by Hornady Manufacturing Company, Box 1848, Grand Island, Nebr. 68801.

To progressively reload a plurality of shells, the turret section 16 includes a carriage 38, a shell holder 40 and an advancing mechanism (not shown in FIG. 1) for moving the shell holder 40. The shell holder 40 is shown supporting certain shell or cartridge casings in different stages of refinishing and reloading. The carriage 38 is connected to the yoke 34 to be raised and lowered thereby through the frame 12 and supports the shell holder 40, with the advancing mechanism being within the carriage to move the cartridge casings from station to station during the reloading process.

The refinishing and loading section 18 rests upon the top supporting plate 28 and contains the tools to refinish casings. Beneath it on the base 22, there are: (1) the case ejection assembly 20 to automatically eject cartridges; and (2) an automatic primer to prime the shells. The case ejection assembly 20 includes a cartridge catcher assembly 29, a kicker assembly 31, partly hidden in FIG. 1 and a cam 53.

Figure 2:
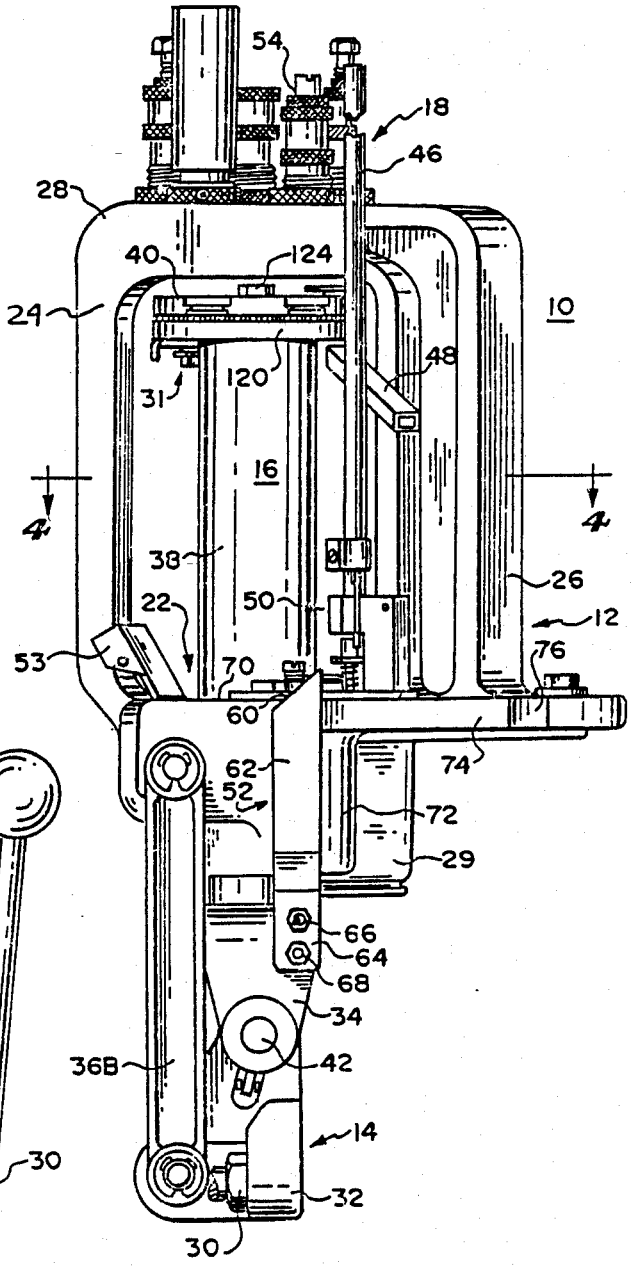
FIG. 2 is a side elevational view of the loader of FIG. 1.

In FIG. 2, there is shown a side elevational view of the reloading apparatus 10 with the handle 30 pulled downwardly to a substantially horizontal position from the substantially vertical position shown in FIG. 1. In this position, the linkage arms 36A and 36B are vertical, causing the rocker arm 32 to pivot about a pivot point 42 in the yoke 34 to lift the turret section 16 upwardly by forcing the carriage 38 with the shell holder 40 upwardly. In this position, shells are located by the shell holder 40 in a position to be acted upon the tool and loading section 18.

To provide for a automatic priming, the loader includes a primer feed tube or chute 46, a spent primer drop tube 48, an automatic feeder 50, a primer cam assembly 52 and a sizing and depriming tool 54. When the handle 30 is pulled horizontally as shown in FIG. 2 forcing the carriage 38 and shell holder 40 upwardly, the die in the sizing and depriming tool 54 forces the spent primer out of the shell and through the primer drop tube 48 where it drops free.

When the handle 30 is pulled upwardly as shown in FIG. 1, the carriage 38 moves downwardly so that a shell mounted in the rim of the shell holder 40 moves down to the priming position. In the priming position, a new primer is near the base as the shell holder moves downwardly. In the last station, as the shell holder moves downwardly, a shell is ejected.

To provide automatic priming, the primer cam assembly 52 includes a cam surface 60, an arm 62 and a mounting portion 64. The mounting portion 64 is fastened to the yoke 34 by bolts such as those shown at 66 and 68 so that it moves upwardly when the carriage 38 is moved upwardly. The arm 62 extends between the hole 34 to which it is fastened and a location above the base 22 when the carriage 38 is fully extended and at this time the cam surface 60 contacts the automatic feeder 50 to move an arm therein which feeds one primer under the rim of the shell holder 40 to be aligned with the center of the shell or cartridge casing.

As best shown in FIG. 2, the base 22 of the frame 12 includes: (1) a top surface 70 against which the automatic feeder 50 is mounted; (2) a central portion 72 having a hole in it substantially the same size as the carriage 38 to permit the carriage 38 to move therethrough and proving sufficient bearing surfaces to steady the carriage 38 as it moves upwardly and downwardly; and (3) an extending mounting section 74 having one or more apertures 76 for mounting the frame 12 to a work bench or the like. The first and second upstanding columns 24 and 26 provide sufficient height between the top surface 70 and the refinishing and loading section 18 to permit the shell holder 40, shells and a section of the carriage 38 upward and downward movement.

To permit priming, the rim of the shell holder 40 extends beyond the carriage 38 a sufficient distance to receive the primer and the portion of the automatic feeder 50 to insert it thereunder and the automatic feeder 50 is moved by the cam surface 60 a sufficient distance to move a primer from the feed tube 46 into a path under the shell within the rim. The distance from the edge of the rim to the location of the automatic feeder 50 must be at least one half the diameter of a shell.

To activate the case ejection assembly 20 (FIG. 1), the cam 53 is mounted below the kicker assembly 31 to engage and disengage a cam follower thereon as the carriage 38 moves upwardly and downwardly. In the preferred embodiment, the downward movement of the carriage 38 moves the cam follower, causing it to move a kicker arm against the bias of a spring, with the kicker arm responding directly to the cam follower to knock the shell into the cartridge catcher assembly 29. This action occurs during the final downward motion of the carriage 38 and is coordinated with the final rotation of the shell holder 40 as the carriage 38 is moving straight downwardly to insert a primer in the primer station. The only two stations on the surface of the base in the preferred embodiment are: (1) the priming station which is located angularly 36 degrees from the adjacent stations on the refinishing and loading section above it; and (2) the case ejection assembly 20 (FIG. 1) which serves as a station but includes a cartridge kicker mounted to the subplate 184 (FIG. 8) to be approaching the base when in use. It engages a cam on the base and includes a lever that engages the cam while the carriage is moving vertically downwardly with rotation.

Figure 3:
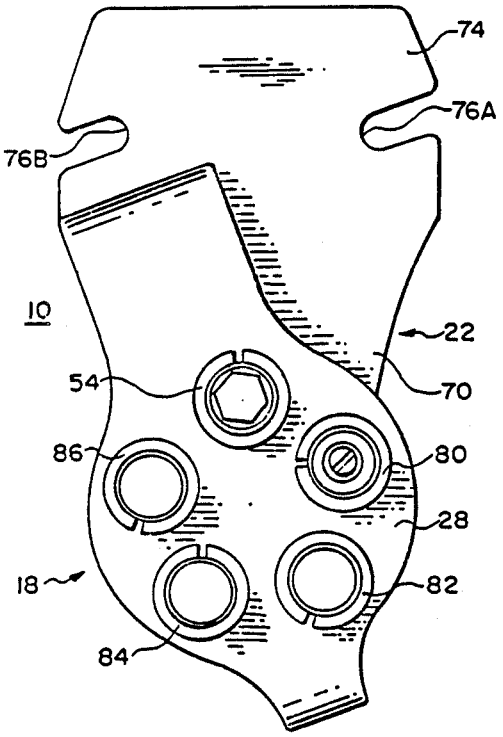
FIG. 3 is a plan view of the loader of FIG. 1.

In FIG. 3, there is shown a top view of the reloading apparatus 10, showing the refinishing and loading section 18 and the base 22 of the frame 12 (FIGS. 1 and 2). The refinishing and loading section 18 includes the top supporting member 28 to which a plurality of tools including the sizing and depriming tool 54 are mounted thereon so that, as the carriage 38 (FIGS. 1 and 2) moves the shell support between the base 22 and the top member 28, the shells mounted thereon are progressively acted upon the tools on the top member 28, with each shell being moved one station at each operation to progressively perform the next operation on the next of the shells mounted within the shell holder 40 (FIG. 2).

The different stations are mounted to the top of the top supporting member 28 to cooperate with the shells in the shell holder 40 (FIG. 2) and include the sizing and depriming tool 54, a neck expanding tool mounted a 80, a powder charge supply station mounted at 82 to supply powder after the shell has been formed, a bullet serrating and/or crimping tool at 84 and a taper crimping tool in the case of pistol bullets at 86. Beneath the top supporting member 28, the base 22 extends to provide the mounting portion 74 with the openings 76A and 76B to mount the reloading apparatus 10 to an appropriate work bench.

Not all of the stations shown in FIG. 3 need be mounted but they may be selected for the particular shell or cartridge upon which work is to be done. The use of such station is conventional and known in the art and other arrangements are known and may be used instead of the arrangement shown in FIG. 3.

Figure 4:
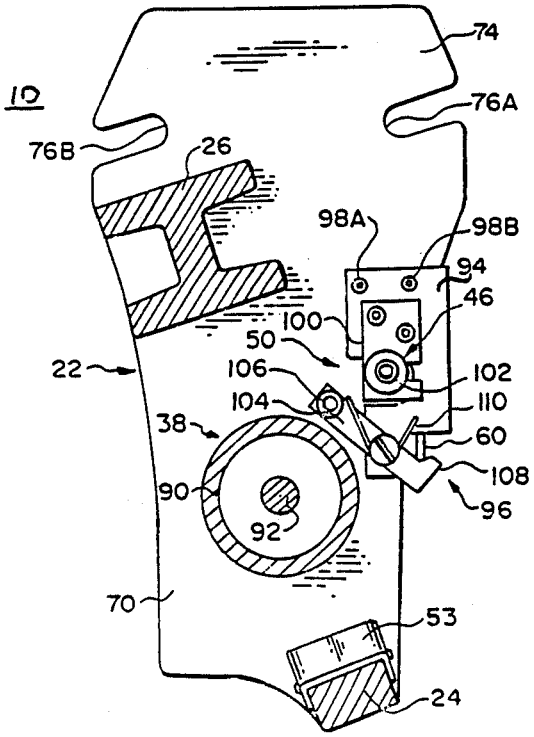
FIG. 4 is a plan sectional view of the loader of FIG. 1 taken through lines 4—4 in FIG. 2.

In FIG. 4, there is a top sectional view of the reloading apparatus 10 taken through the lines 4—4 on FIG. 2, showing the carriage 38, the automatic feeder 50 and the base 22. As shown in this view, the first and second support columns 24 and 26 extend upwardly from the base 22 and the carriage 38 extends therethrough adjacent to the automatic feeder 50 which feeds primers to it. The cam 53 is mounted to the column 24 and extends beneath the edge of the shell holder 40 of the section 16 (FIGS. 1 and 2) to engage the kicker assembly 31 (FIGS. 1 and 2) when the carriage 38 is lowered and to disengage the kicker assembly 31 when the carriage 38 is raised.

The carriage 38, in the preferred embodiment, includes a tubular wall 90 and an indexing shaft 92 centrally located within the tubular wall 90. In the preferred embodiment, the tubular wall 90 is cylindrical and has a sufficient moment of inertia to avoid buckling when the tools work on the shells at one end of the shell holder 40 (FIG. 2). The indexing shaft 92 is also cylindrical and has: (1) short enough length and a large enough moment of inertia to rotate the shell holder 40 from station to station without distortion of the indexing shaft 92; and (2) a long enough length to extend from the indexing wheel to the shell holder 40 (not shown in FIG. 4) through the tubular wall 90 as explained hereinafter.

The automatic feeder 50 includes a feeder base plate 94, the primer chute assembly 46 and a primer feed arm 96. The base plate 94 is mounted to the support surface 70 of the loader base 22 by any convenient means such as by the machine screws shown at 98A and 98B and supports the primer feed arm 96 and the primer chute assembly 46.

To supply primers to the automatic feeder 50, the primer chute assembly 46 includes a body portion 100 mounted to the base plate 94 and a hollow cylindrical primer tube 102 which includes stacked primers extending downwardly to the surface 70.

The primer feed arm 96 includes a primer moving section 104, a primer punch and a seat assembly 106, a cam follower 108 and a spring 110. The spring 110 is mounted to the baseplate 94 at one end and at its other end to the primer moving section 104 to bias the primer punch and seat assembly 106 is a position where it underlies the shell on the shell holder 40 (FIG. 2) when that holder is moved downwardly. In the preferred embodiment, that location is $1\frac{1}{2}$ inches from the center of the tubular wall 90 which is a center of revolution of the shells on the shell holder 40 (FIG. 2).

The primer punch and seat assembly 106 is sized to receive a primer snugly and the primer moving section 104 swings under action of the cam follower 108 through an arc that brings it underneath the hollow cylindrical tube 102 where it trips a spring catch and permits a primer to be seated in the primer punch and seat assembly 106 for removal.

The primer punch and seat assembly 106 is supported by a compression spring at a height of approximately $\frac{1}{4}$ inch and it presses a trip under the hollow cylindrical tube 102 to release the primer and moves it laterally by the spring back to the location where shown in FIG. 4 for insertion into the shell. The hollow cylindrical tube 102 is elevated from the bottom of the support 70 by slightly less than $\frac{1}{4}$ inch to permit removal of the primer.

The primer feed arm 96 includes a pivot point with the cam follower 108 on one side and the primer moving section 104 on the other side. The cam follower 108 is shaped so that when it is moved by the cam surface 60, the primer punch and seat assembly 106 is swung on the primer moving section 104 through the distance between the location where shown at FIG. 4 and the hollow cylindrical tube 102 to receive a primer. In the preferred embodiment, this is an arc of approximately 30 degrees. The distance from the center of the primer punch and seat assembly 106 and the center of the pivot point is $1\frac{1}{4}$ inches and the distance to the cam follower 108 is approximately $\frac{1}{2}$ inch. The primer is more fully described in the aforementioned U.S. Pat. No. 4,526,084 to David et al.

Figure 5:
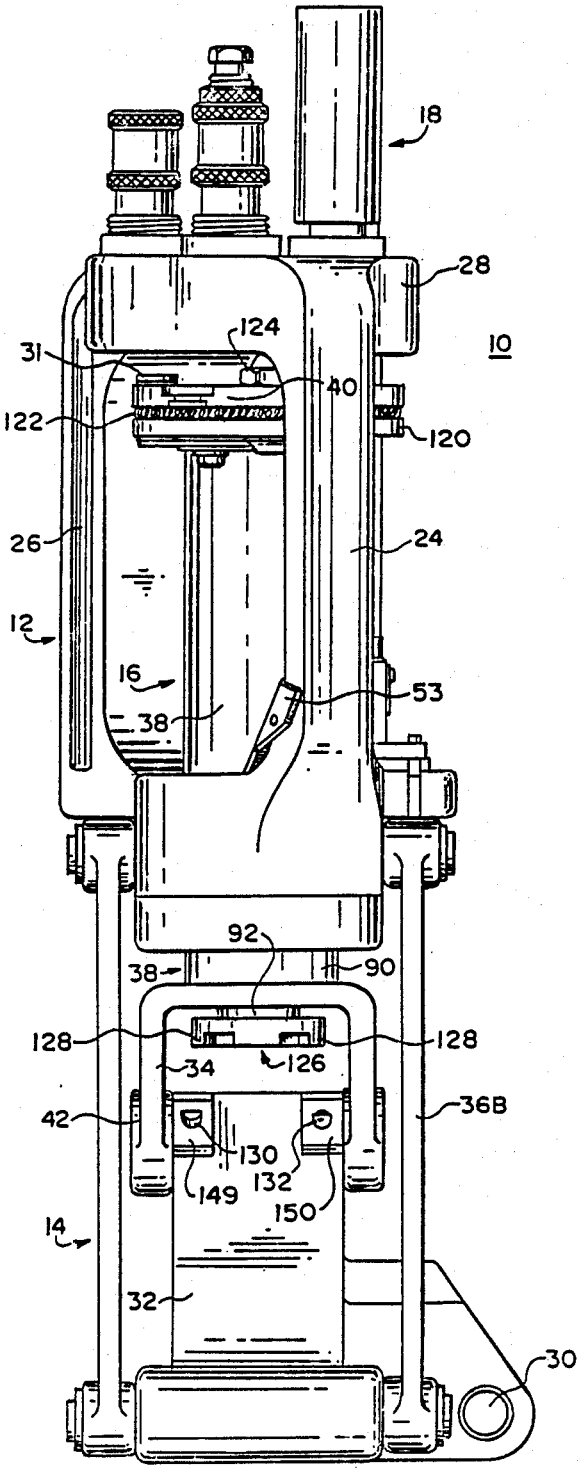
FIG. 5 is a front elevational view of the loader of FIG. 1.

In FIG. 5, there is shown a front elevational view of the reloading apparatus 10 with the handle 30 pulled horizontally to pivot the rocker arm 32 upwardly, thus lifting the yoke 34, carriage 38 and the shell holder 40 toward the refinishing and loading section 18. As best shown in this view, the turret section 16 includes an advance mechanism which cooperates with the shell holder 40 and the drive means 14 to turn the shell holder 40 from position to position for progressive working of the shells. It is part of the carriage 38 and is similar to the advance mechanism described in U.S. Pat. No. 4,031,804, issued to Richard C. Boschi on June 28, 1977, and assigned to Pacific Gunsight Company and similar to the aforementioned U.S. Pat. No. 4,526,084 to David et al.

To permit the shell holder 40 to rotate with respect to the carriage 38, the carriage 38 includes an outer cylinder rim 120 having openings underlying the openings in the shell holder 40 adjacent to the depriming tool and supporting a compression spring 122 about is periphery. A bolt 124 tightens the shell holder 40 against the drive shaft 92 to permit it to rotate but holds it firmly in place except as to rotating motion.

To provide rotation, the drive shaft 92 includes at its upper end a key and keyway for rotating the shell holder 40 (not shown in FIG. 5) and at its bottom end an indexing wheel 126. The indexing wheel 126 has a rounded periphery with five indexing cams extending radially from the drive shaft 92 and spaced having certerlines from each other by 72 degrees. The cams 128 are positioned to cooperate with first and second pawls 130 and 132 mounted to the rocker arm 32 and extending a sufficient distance outwardly to contact cam surfaces as the rocker arm is pivoted.

The pawl 130 contacts a cam surface and moves it 36 degrees clockwise as the carriage 38 is lifted upwardly, and, as the carriage 38 is moved downwardly to move one full station, the pawl 132 contacts cam surface 128 and rotates the wheel 126 a further 36 degrees in the same clockwise direction. The movement is clockwise when viewed from the top of the reloading apparatus 10. The last $\frac{1}{8}$ inch downward motion of the carriage seats the primer in the shell.

Figure 6:
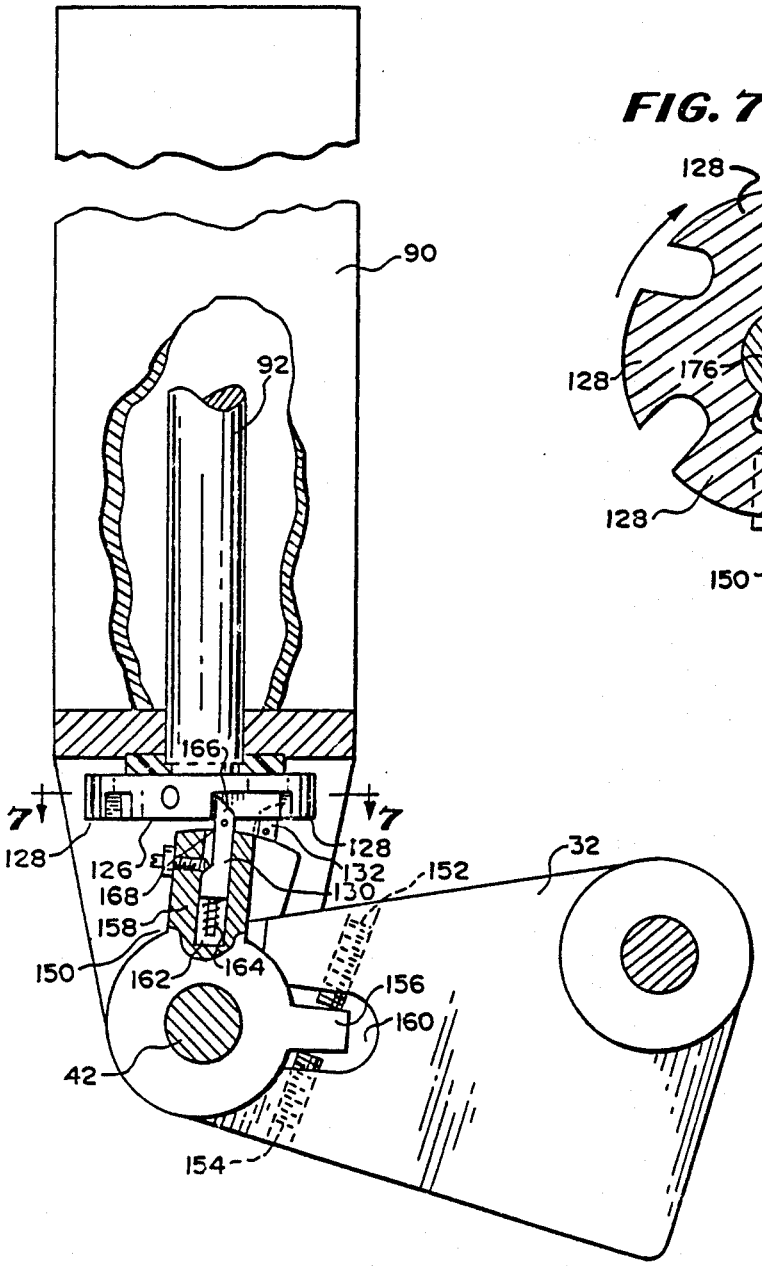
FIG. 6 is an elevational view partly broken away of a carriage, carriage drive and indexing assembly which are a portion of the embodiment of FIG. 1.

In FIG. 6, there is shown an elevational view of the tubular wall 90 partly broken away to show the indexing shaft 92 connected to the indexing wheel 126 at the yoke 34 (FIG. 5). As best shown in this view, the pivoting of the rocker arm 32 on the yoke 34 (FIG. 5) lifts the carriage 38 (FIG. 5) and at the same time controls the motion of the pawls such as the pawl 130 to time the rotation of the index wheel 126 and index shaft 92.

A pawl housing 150 is mounted for rotation about the pivot point 42 under driving force of the rocker arm 32 in the drive means and held in an adjustable position by the two screws 152 and 154. The pawl housing 150 is generally cylindrical with a central cylindrical opening through its center for the pivot point 42, an adjusting boss 156 and an extending pawl mounting boss on its end, one pawl mounting boss being shown at 158.

The pawl mounting bosses of the right and left pawl housing 149 (FIG. 5) and 150 hold within them the right and left pawls 130 and 132 respectively which control the timing of the motion of the index wheel 126 and index drive shaft 92 to cause the shells to move progressively from station to station in synchronism with vertically upward motion to some working stations and vertically downward motion to other working stations.

To permit an adjustment of the angle at which the indexing shaft 92 is turned in relation to the position of the shaft 90 vertically in response to the horizontal motion of the pawls, the adjusting boss 156 rests within a groove 160 at a location controlled by an adjusting means that includes the two screws 152 and 154. Each of the screws 152 and 154 threadably extend through the rocker arm 32 and contact a different side of the adjusting boss 156. Consequently, by loosening one of the screws 152 and tightening the other screw 154, the adjusting boss 156 is located in position within the rocker arm 32.

The adjusting boss 156 extends radially from the cylindrical pawl housing 150 so that its position within the rocker arm 32 determines the position of the pawl mounting bosses 158 angularly with respect to the rocker arm 32 and thus the relative position at which the pawls contact the cam surfaces of the indexing wheel 126 with respect to the vertical position of the indexing shaft 92.

During the indexing of the indexing shaft 92, a pawl in one side of the pawl housings 149 (FIG. 5) and 150 drives the indexing wheel 126 while a corresponding pawl on the opposite pawl housing is being driven. The driven pawl (not shown in FIG. 8) is driven substantially vertically downwardly by motion of an a cam surface against a surface in the same direction as the indexing shaft 92 and at a direction orthogonal to the plane of the indexing wheel 126.

To permit this downward motion of the pawl, the pawl housings each include a pawl mounting bore such as that shown at 162 in housing 158. A helical compression spring such as 164 is in the bore and holds the pawl 130 upwardly against an adjustable restraining set screw at a shoulder but permits it to be driven downwardly by a cam surface. Each of the pawls has a vertical straight surface on one side and a tapered surface 166 on the opposite side which when contacted by one of the cam surfaces of a cam 128, exerts sufficient force against the helical spring 164 to move the pawl 130 downwardly and out of the path of the cams 128. Thus, the straight sides face the same direction in an imaginary circle drawn around the loader and are contacted by cam surfaces moving clockwise from the top of the loader.

For this purpose, the slanting surface 166 must have an angle sufficient to form a downward component of the force from the cam greater than the biasing force of the spring 164 which forces the pawl upwardly. In the preferred embodiment, a 40 degree angle is utilized but other angles are appropriate provided they exert a sufficient vertical force to move the pawl downwardly. The cams 128 are driven clockwise by the vertically straight, horizontally cylindrical surface of the pawl such as that shown at 168 so there is no vertical component of force and the forces are principally in the horizontal plane to drive the index wheel.

To mount the indexing shaft 92 to the indexing wheel 126, the indexing wheel 126 is fixedly fastened to the bottom of the indexing shaft 92 by means of a pin passing through the shaft 92 and in a groove in the indexing wheel 126 as described hereinafter.

Figure 7:
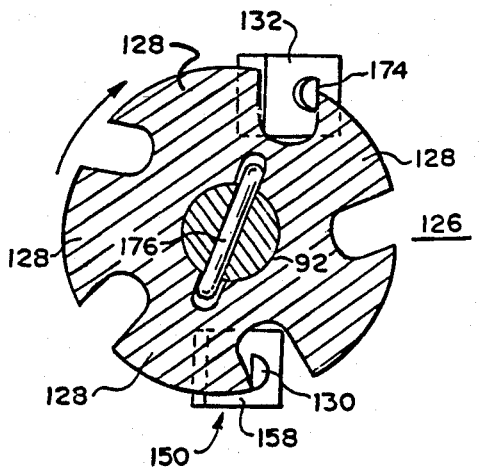
FIG. 7 is a fragmentary, sectional plan view through lines 7—7 of FIG. 6 of an indexing mechanism, which is a portion of the embodiment of FIG. 1.

In FIG. 7, there is shown a fragmentary plan sectional view of the indexing wheel 126, the pawl mounting bosses and the indexing shaft 92. The pawl 130 is shown extending from the mounting boss 158 in driving engagement with a cam, having its straight vertical edge pushing against the cam surface while the pawl 132 has its slanted surface 174 being driven by a cam 128 to exert a downward force and drive it into its corresponding boss against spring bias and out of the path of rotation of the indexing wheel 126. The indexing wheel 126 is rotating clockwise.

The rotation of the indexing wheel 126 turns the indexing wheel 92 which is mounted to the indexing wheel 126 by a pin 176 passing through their centers.

The angle of the sloping side of the pawls with respect to the horizontal must be 40 degrees or less to exert sufficient downward force.

To control the timing of the rotation in the upward and downward movement of the carriage, the radial length of the cams 128 are equal. The rotation occurs from the time of contact of the pawl with the cam surface until the pawl's position with respect to the cam moves radially downwardly and finally passes radially down to cease exerting force upon the indexing drive shaft 92.

The radial length of the cams 128 is between ¼ inch to 2 inches and the exact placement of the cam surface and pawl is set to cause the rotation of the index wheel 126 to locate the shell holder 40. The shell holder must be properly aligned with both so that the shells are aligned with the proper stations when the carriage 38 is in its lowermost position for priming and in its uppermost position for cooperation in the refinishing and loading station.

The number of cams is equal to 360 degrees of arc divided by twice the smallest arc length between stations. For stations equally spaced, the number of cams is equal to one-half the maximum number of stations in a circle on the top and a circle on the bottom. The stations are staggered on the top and bottom to cooperate with two pawls which alternatively drive different cams to provide rotation in the same direction on both the vertical upward movement and the downward movement.

The pawls are also positioned for precision of the location of the stations during rotation. The radial length of the cmas and the position of the pawls control the amount and time of rotation of the shell holder 40 during raising and lowering of the shell holder 40 during raising and lowering of the carriage and are selected to align the shells with the work stations at the time the work stations operate on the shells. Thus, the shell holder 40 is rotating during movement vertically near a center of the vertical stroke and then moved straight to the work station. The pawls and cams are in contact during the rotation of the shell holder and out of contact during straight vertical movement.

As the carriage 38 is lifted, the pawl on one side moves upwardly and contacts a cam 128 after the shell loader has been lifted from the base surface 70. As the carriage 38 continues to move upwardly, the pawl on one side drives the cam and slides along its surface along a line extending radially outwardly from the index wheel 126, with the index wheel 126 turning the shell plate.

As the index wheel 126 rotates and the pawl slides with the index wheel 126 moving upwardly, the index wheel 126 rotates through 36 degrees, and at that point, the pawl moves down out of the depression in the index wheel and slides off while the index wheel 126 continues moving upwardly. On the opposite side, a cam has contacted the other pawl at the same time but on its slanted surface so that the pawl is depressed downwardly into the pawl housing 150. As the carriage 38 moves further upwardly, it does not rotate and it is rotationally stationary as it moves up to the finishing and loading station for operation on the shells.

In the downward stroke, the shell holder 40 moves straight down for a period of time until the opposite pawl has its straight edge contacting the cam on the way down. As it moves down, it drives the indexing wheel 126 and shell holder 40 in the same direction through another 36 degrees while the carriage 38 moves closer to the housing downwardly and the rotation of the indexing wheel 126 causes the pawl to slide radially outwardly and downward with respect to the indexing wheel 126 until it slips below and out of engagement.

While the driving pawl is contacting a cam with its straight cut-away portion, the pawl on the other side which did the driving on the upward stroke is contacting a cam on its slanted edge and being depressed while it slides radially outwardly beyond the length of the cam. Thus, the radial lengths of the pawls control the number of degrees of rotation and may be adjusted in accordance with the angular degrees between a station in the shell finishing and loading section and stations on the surface of the base.

Figure 8:
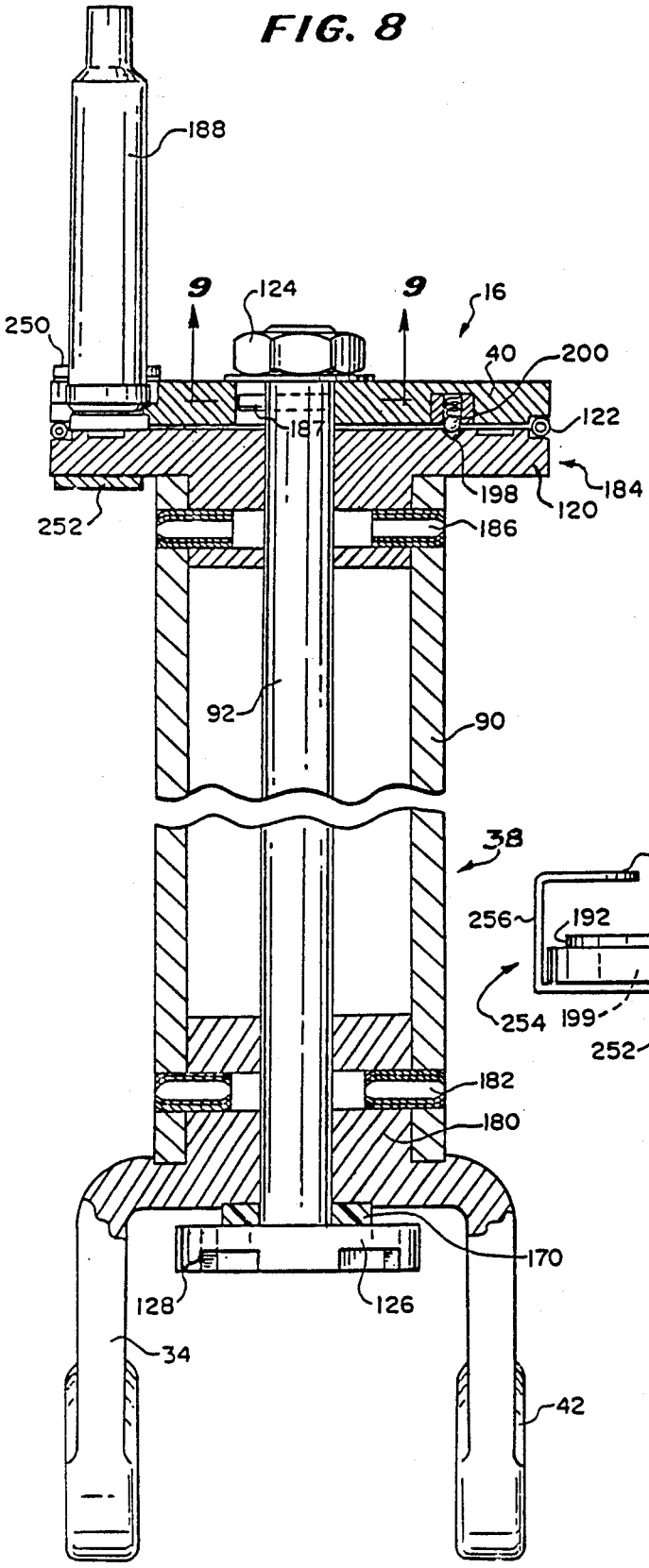
FIG. 8 is a partly fragmentary, sectioned view, partly broken away, of a carriage, carriage drive, turret and indexing assembly, which are a portion of the embodiment of FIG. 1.

In FIG. 8, there is shown a partly broken away elevational view partly sectioned of the turret 16 including the carriage 38. As best shown in this view, the tubular walls 90 are tightly fitted on the yoke 34 about a cylindrical casting at 180 and held in place by pins 182 to be lifted and lowered together with the yoke 34. The indexing shaft 92 passes through the casting 180 so as to rotate therewithin.

At the top of the tubular walls 90, the subplate 184 is fitted within the tubular walls and held in place by pins 186 to be raised and lowered therewith while the indexing shaft 92 rotably passes therethrough and is held at the top by a nut 124 in engagement with the shell holder 40. If it is desired to put a different shell holder on, the nut 124 may be easily unthreaded, the shell holder 40 removed and a new one located in its place.

The shell holder 40 is mounted for rotation with the indexing shaft 92 by a pin 187. The subplate 184 has cut-away portions which receive the spring 122 to hold shells such as that indicated at 188 in place. The shells may be different sizes and because of the construction of the shell holder opening and grooves in the subplate 184 the spring holds them tightly in place. Moreover, the shells may be pulled free against the tension of the spring with moderate pressure while still being held firmly enough to be worked upon by the refinishing and loading section.

At the shell ejection station, the shell contact portion 250 of a kicker arm within the kicker assembly 31 (FIGS. 1 and 2) extends above the shell plate 40 and a horizontal lever portion 252 of the kicker arm extends below the subplate 184 so that when the horizontal lever portion 252 is moved by the cam 53 (FIGS. 1 and 2), the shell contact portion knocks the shell into the cartridge catcher assembly 29 (FIG. 1).

Figure 9:
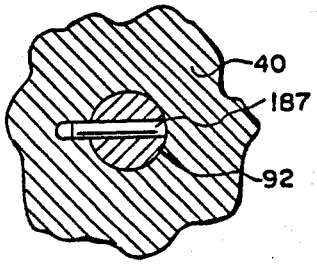
FIG. 9 is a fragmentary sectional view of a portion of the embodiment of FIG. 1 taken through lines 9—9 of FIG. 8.

In FIG. 9, there is shown a sectional view of a portion of the shell plate 40, the indexing shaft 92 at its top and the pin 187 illustrating the manner in which the shell plate 40 is attached to the indexing shaft 92 for rotation therewith. Obviously, other methods of attaching the two may be utilized but the pin is particularly convenient because it allows for ease of interchange of various shell plates that accommodate different size shells or a different number of shells for different configurations.

Figure 10:
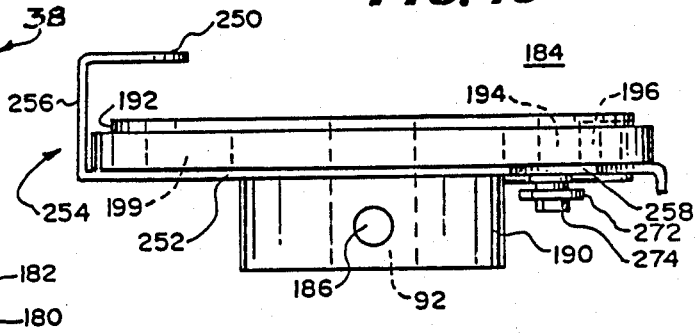
FIG. 10 is an elevational view of a turret which is a portion of the embodiment of FIG. 1.

In FIG. 10, there is shown a side view of the subplate 184 with the kicker arm 254 attached. The subplate 184 includes a collar 190 through which the indexing shaft 92 passes along an axis and with the transverse aperture 186 therein to receive a roll pin for holding the subplate 184 to the tubular walls 90 (FIG. 8) for vertical motion therewith. Mounted above the collar 190 is the rim 120 (FIGS. 2 and 8) extending outwardly and having in the top surface of its upper periphery a spring receiving groove 192 and (plurality of seating slots) extending inwardly to receive shells. The kicker arm 254 includes a vertical connection portion 256 connecting shells contact portion 250 and the lever portion 252 to form a sidways "U". A fulcrum portion 258 extends at an angle from the lever portion and is pivotally pinned by an arm attach bolt 274 and a lock nut 272 to a taped hole in the bottom of the subplate 184. A return spring is also mounted by the bolt and nut to bias the kicker arm 254 in place.

Some of the seating slots include holes extending entirely through the rim such as those shown at 194 and 196 to expose the bottom of the shell and thus permit cooperation of shells with stations on the top surface of 70 (FIG. 1) of the base of the loader when the carriage 38 is in its lowermost portion. Other seats hold shells in place in a manner to be described more completely hereinafter for interaction with the refinishing and reloading station at the top of the movement of the carriage 38. Similarly, at 199 a radially extending ear is supplied for cooperation with the stations at the surface and at a location of approximately 1.125 inches from the center of the subplate 184, there are 10 apertures which cooperate with a detent on the bottom side of the shell plate. The detent extends downwardly from the shell holder 40 to cooperate with the apertures in the subplate surface in a manner to be described hereinafter.

Figure 11:
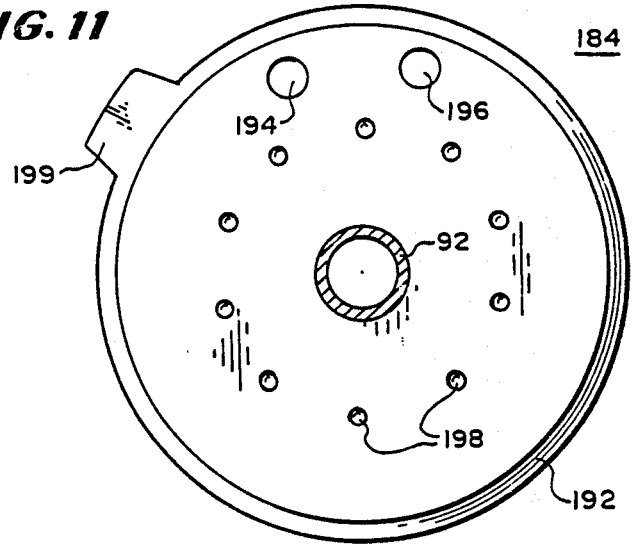
FIG. 11 is a plan view of a subplate which is a portion of the embodiment of FIG. 1.

In FIG. 11, there is shown a plan view of the subplate 184 showing the ear 199 extending radially from the subplate 184 with the indexing shaft 92 extending through a central aperture for rotation within the plate. The position of the apertures 194 and 196 are located to cooperate with the surface 70 (FIG. 1) of the base of the loader when the carriage 38 is at its lower position, at which time the shell holder 40 has been indexed so that shells for priming or the like, at the bottom, are exposed to the work stations. Ten apertures 198 are radially spaced from the center of the indexing shaft 92 at a distance of 1.125.

Figure 12:
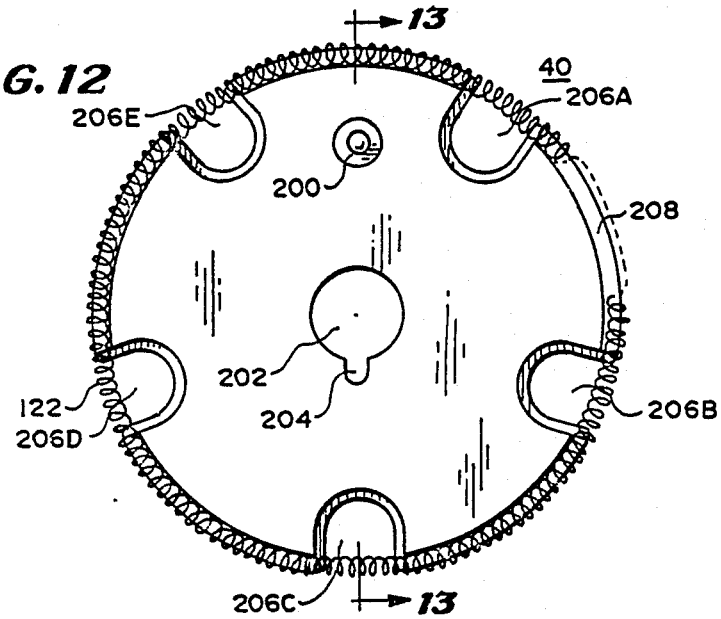
FIG. 12 is a bottom view of a shell holder which is a portion of the embodiment of FIG. 1.

In FIG. 12, there is shown a bottom view of the shell plate 40 having a detent 200 at a distance from the center corresponding to that of the ten apertures 198 (FIG. 11) on the subplate 184 to provide for seating of the shell plate 40 in any of ten positions, five of which are to be used in the refinishing carriage and others of which are to be used at the lowermost position of the carriage where the shells are brought into contact with a station or stations mounted on the surface 70 (FIG. 1) of the loader 10.

At the center of the shell holder is a keyway opening 202 sized to fit outside of the indexing shaft 92 (FIG. 13) and receive a key or pin at 204 for the purpose of causing rotation of the shell plate 40 with the indexing shaft 92. Around the periphery of the shell plate are a plurality of shell holding stations 206A–206E each of which is adapted to hold a shell. The number of shell holding stations is half the number of openings 198 or seating positions so that there is a provision for two stations for each shell to accommodate rotation of the shell plate 40 on both the upper and the lower motions of the carriage 38. With this provision, a lower vertical height of the loader may be used and a smaller shell plate.

Although the preferred embodiment includes provisions for five shells and ten possible resting locations for working the shells, other numbers of shells may be used and it is not necessary to have half the number of shells as there are detents or angular positions of the plate but it is only necessary that the shells be aligned in register with the stations when they reach the stations and the rotation of the plate must be indexed with sufficent precision for that purpose.

To permit ease of rotation of the shell holder 40 with the subplate 184, a spring holding groove 208 is provided to receive the retaining spring 122 to hold the shells in place even though they may be of different sizes. The spring holding groove 208 is provided around the periphery at the bottom of the shell holder 40.

Figure 13:
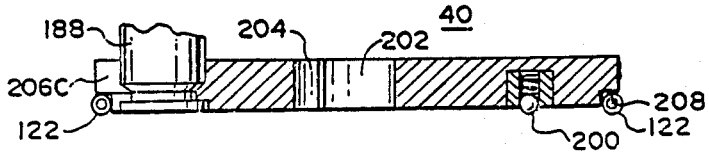
FIG. 13 is a sectional view taken through lines 13—13 of FIG. 12 of a portion of the embodiment of FIG. 1.

In FIG. 13, there is shown a sectional view taken through lines 13—13 of FIG. 12 showing the shell holder 40. As best shown in this view, the spring 122 grips the edge of a shell 188 seated within one of the shell seats 206C to hold it in place beyond the walls 90 (FIG. 8) of the carriage 38. With this arrangement, the shell is held inwardly even though it may be of smaller size than the shell holding opening 206C yet may be easily knocked free by the kicker arm impact area 250 (FIG. 10) which is mounted sufficiently high to cause the shell to pivot about its seat and free itself from the spring 122.

Figure 14:
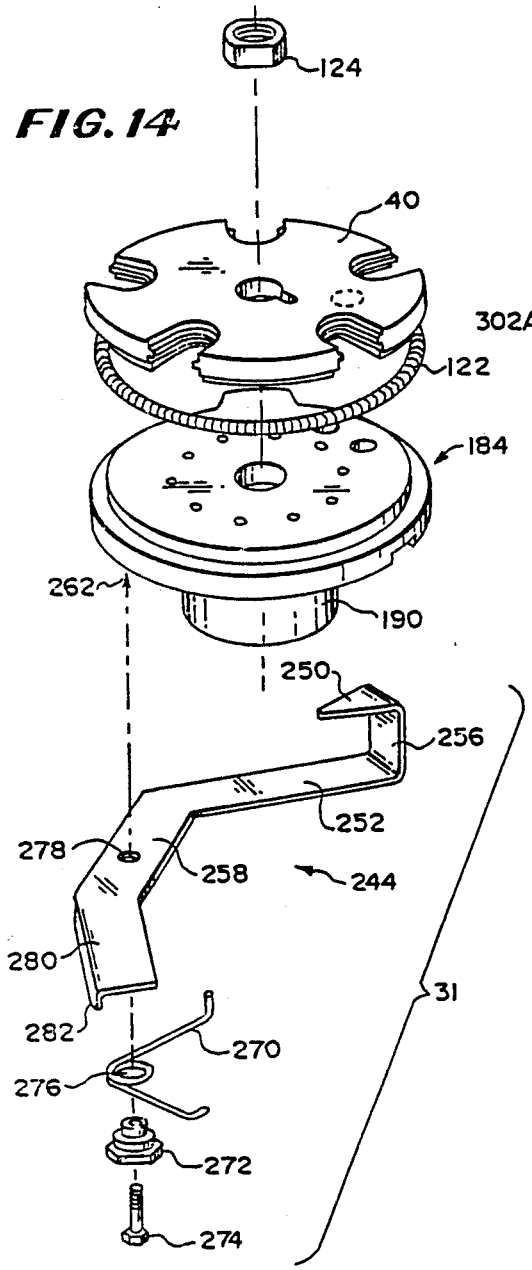
FIG. 14 is an exploded perspective view of a kicker assembly, subplate and shell holder included in the embodiment of FIG. 1.

In FIG. 14, there is shown an exploded perspective view of the kicker assembly 31, the subplate 184 and the shell holder 40. As shown in this view, the kicker assembly 31 includes a kicker arm 244, a biasing spring 270, a lock unit 272 and a bolt 274. The kicker 244 is pinned at 262 by the bolt 274 and lock nut 272, with the bolt 274 holding the spring 270 in the underside of the kicker arm 244 with a central loop 276 circumscribing an aperture 278 which is aligned with a taped hole in the bottom of the subplate rim 184. The lock nut 272 is between the spring 270 and the bolt 274 so that the bolt 274 pivotably mounts the kicker arm 244 to the bottom of the rim of subplate 184 with its shell contact portion 250 extending over the shell plate 40 and the biasing spring 270 biasing it in this position so that when cammed, it hits a cartridge and eject it from the shell holder over the top of the torsion spring 270.

To properly time the ejection of shells from the shell ejection station, the shell kicker arm 244 includes a camming section 280 on the opposite side of the pivot hole 278 from the shell contacting portion 250 with a distance between the shell contacting portion 250 and the camming section 280 being equal to the distance between the shell ejection station opposite the shell catcher assembly 29 (FIG. 1) and the cam 53 (FIG. 1). The cam 53 may be located in different locations but must be positioned to engage the camming surface 280 at the shell ejection station while the shell contacting portion 250 is adjacent the shell.

In the preferred embodiment, the camming section 280 has a downwardly and inwardly directed flange 282 which permits it to engage in a sliding relationship of the downwardly and outwardly angled surface of the cam 53 (FIG. 1) in a direction with the same circular orientation as the movement of the shell engaging section 250 against the shell when ejecting it. The angle of the cam 53 corresponds to the angle of the flange 282 and is proportioned so that in the downward movement of the flange 282 while it is in contact with the cam 53, the shell contacting portion 250 is moved a distance of between 1 mil and 1 inch with a force of at least 1 ounce.

In the preferred embodiment, the horizontal lever section 252 and the cam section 280 are each at an angle with the fulcrum section 258 to form segments of a curve adapted to fit about the collar 190. The torsion spring 270 has a central coil 276 and two outwardly extending arms, with the two arms being sized to engage the periphery of the collar 190 so that, when the arm 244 is cammed into engagement with a shell, the torsion spring 270 exerts a counter force to return it to its position after the shell has been ejected.

Figure 15:
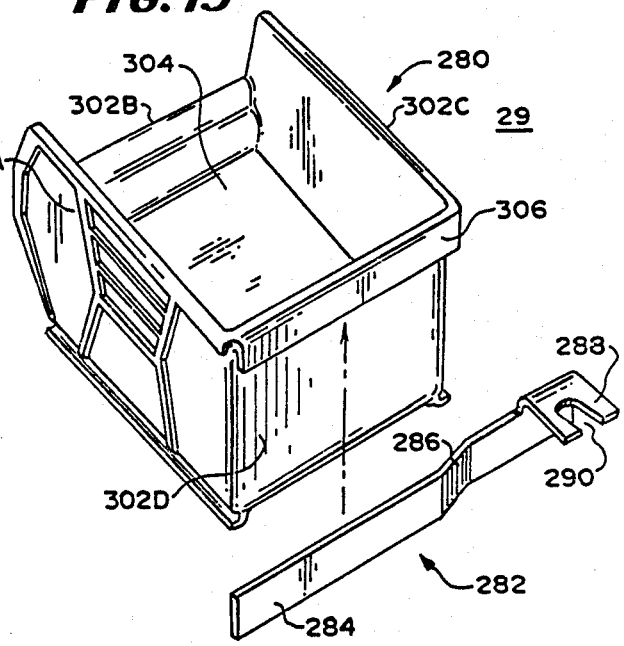
FIG. 15 is an exploded perspective view of a cartridge catching assembly used in the embodiment of FIG. 1.

In FIG. 15, there is shown an exploded perspective view of the cartridge catcher assembly 29 having a cartridge holder 280 and a mounting bracket 282. The mounting bracket 282 is adapted to be mounted along the side of reloader 10 and to support the shell holder 280 in a position where the shell ejection assembly 31 (FIG. 1) can impel the reloaded cartridges into the shell holder 280.

The bracket 282 includes an elongated vertical support plate 284, a vertical offset member 286 and a horizontal bolt mounting 288. The offset member 286 is vertically offset from the vertical support member 284 to form a gooseneck and has the bolt holding member 288 extending horizontally from its upper end and containing an aperature 290 sized to receive the shank of a bolt 300 (FIG. 1) to hold the mounting bracket 282 in place along the side of the loader. The bolt 300 (FIG. 1) extends vertically through the base of the reloader and may also be used to mount the reloader to a table of work bench or the like.

The shell holder 280 is an open topped container having four vertical side plates 302A–302D, a bottom 304 and a downwardly extending mounting lip 306. The lip 306 is mounted to the upper end of one side 302D of the container 280 and is connected at the top and spaced and parallel to the wall 302D so that it may be positioned over the bracket 284 to hold the shell holder 40 in place.

The downwardly extending lip 306 and the bracket 284 are sufficiently strong to support a shell holder full of reloaded shells firmly in place and may be of metal or any other similar material. The vertical portion of the lip 306 is spaced from its parallel portion of the wall 302D by a distance substantially equal to the thickness of the mounting bracket 284.

In the preferred embodiment, the bracket is formed of 14-guage cold rolled steel with a black oxide finish with the offset portion having a 20 degree angle at the gooseneck between the two vertical portions, the bolt aperture having a width of 17/32 inch, the length of the bracket being 7 inches and its width being 11/16 inch. The thickness should be in a range of between 5 gauge and 25 gauge, the length should be between 2 inches and 10 inches for the lip and matching bracket portion and the width of the bracket should be at least ¼ inch.

Figure 16:
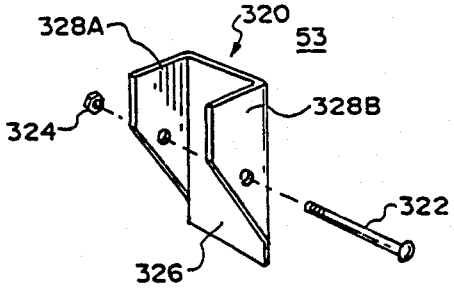
FIG. 16 is an exploded perspective view of a cam used in the embodiment of FIG. 1.

In FIG. 16, there is shown an exploded perspective view of a cam assembly 53 having a cam body 320, a bolt 322 and a nut 324. The cam body 320 includes a flat 18 guage sheet metal center portion 326 having perpendicularly bent sides 328A and 328B adapted to fit around the first upstanding column 24 (FIG. 1), with the sides 328A and 328B having tapered portions sloping towards the tip of the cam 53 adapted to hold the post while the tip extends at an angle to touch the base of the loader. Within each of the two sides 328A and 328B, there are aligned apertures adapted to receive the shank of the bolt 322 so that the bolt may extend through a corresponding aperture and the first upstanding column 24 (FIG. 1) for securely fastening the cam 53 thereto.

In general, in the preferred embodiment, the central plate 326 has a length of 2 inches and a width of approximately 1 inch, with the winged portions being approximately 7/10 inch extending from the plate portion 326. The aperture is mounted approximately 1 inch from the top of the cam plate and ¼ inch from the base 326 to automatically located the angle of the cam 53 at approximately 30 degrees to the normal to the base 22 and in the range of 15 degrees to 80 degrees.

From the above description, it can be understood that the reloader 10 has several advantages such as: (1) it is relatively simple and inexpensive particularly with the simplified one piece indexing wheel; (2) it is easy to assemble; and (3) it permits easy removal and insertion of shells by automatically kicking the reloaded shells into a holder as the loader is progressively operated.

Although a preferred embodiment of the invention has been described with some particularity, many modifications and variations are possible within the light of the above teachings. Therefore, it is to be understood that, within the scope of the appended claims, the invention may be practiced other than as specifically described.

What is claimed is:

1. Reloading apparatus comprising:

carriage means adapted to support a shell holder;

means for moving the carriage means vertically between a first location and a second location;

said shell holder including a plurality of positions for supporting shells;

a plurality of working stations at said first location for operating simultaneously on a plurality of said shells; and at least one working station at said second location, whereby said shells may be refinished and loaded;

means for moving said shell holder from position-to-position between a first station and a last station as said carriage means moves from the first and second location and again when said carriage means moves from the second to the first location, whereby said shell holder is advanced a first predetermined amount when moving from the first to second location and a second predetermined amount when moving from the second to the first location; and said positions of said shell holder being aligned with at least one working station as said first location and one working station at said last location;

cam means and ejector means mounted at said last station for cooperation with each other;

one of said cam means and ejector means being mounted to said carriage means for vertical movement between the first and second locations and the other being stationary;

said ejector means including a cam follower positioned in the path of said cam means as said carriage means moves vertically between said first and second locations, wherein said cam follower is moved by said cam means; and shell contact means connected to said cam follower for ejecting a shell at said last station when said cam follower is moved by said cam means.

2. Reloading apparatus according to claim 1 in which said shell holder includes an annular spring positioned around its outer periphery whereby casings of different sizes may be removably held in place within said casing holder by said spring.

3. Reloading apparatus according to claim 2 in which:

the carriage includes a tubular wall, an indexing shaft centrally located within the tubular wall and an indexing wheel;

the tubular wall having sufficient moment of inertia to avoid buckling when the tools work on the casing at the second position;

the indexing shaft having short enough length and a large enough moment of inertia to rotate the casing holder from station to station without substantial distortion of the indexing shaft and a long enough length to extend from the indexing wheel to the casing holder through the tubular wall;

said indexing wheel including extending cam follower surfaces; and said means for moving the carriage means vertically including cam means adapted to engage said cam follower surfaces for rotating said index wheel as said carriage moves between said first and second locations.

4. Reloading apparatus according to claim 1 in which said ejector includes a lever means having said cam follower on one end and said shell contact means on the other end, positioned for pivotable movement between a shell engaging means and a shell disengaging means and spring means for biasing said lever to one of said shell engaging positions and shell disengaging positions; said cam being positioned to move said lever to the other of said shell engaging position and shell disengaging position; whereby said shell engaging means is adapted to contact said shell and disengage said shell alternatively as said carriage means moves vertically.

5. Reloading apparatus according to claim 1 further including a shell container and means for mounting said shell container adjacent to said shell ejecting means whereby ejected shells are moved into said shell container.

* * * * *